US007693265B2

(12) United States Patent
Hauttmann et al.

(10) Patent No.: US 7,693,265 B2
(45) Date of Patent: Apr. 6, 2010

(54) EMITTER DESIGN INCLUDING EMERGENCY OPERATION MODE IN CASE OF EMITTER-DAMAGE FOR MEDICAL X-RAY APPLICATION

(75) Inventors: Stefan Hauttmann, Buchholz (DE); Jens Peter Kaerst, Göttingen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 886 days.

(21) Appl. No.: 12/300,159

(22) PCT Filed: May 2, 2007

(86) PCT No.: PCT/IB2007/051634

§ 371 (c)(1),
(2), (4) Date: Nov. 10, 2008

(87) PCT Pub. No.: WO2007/132380

PCT Pub. Date: Nov. 22, 2007

(65) Prior Publication Data

US 2009/0103683 A1 Apr. 23, 2009

(30) Foreign Application Priority Data

May 11, 2006 (EP) ..... 06113802

(51) Int. Cl.
*H01J 35/06* (2006.01)

(52) U.S. Cl. ..... 378/136

(58) Field of Classification Search ..... 378/119, 378/121, 134, 136; 313/306, 341, 343, 344, 313/450, 620, 621
See application file for complete search history.

(56) References Cited

U.S. PATENT DOCUMENTS

| | | | | |
|---|---|---|---|---|
| 2,212,827 | A | 8/1940 | Etzrodt | 313/343 |
| 3,914,639 | A | 10/1975 | Barraco et al. | 313/271 |
| 5,291,538 | A | 3/1994 | Burke et al. | 378/145 |
| 6,259,193 | B1 * | 7/2001 | Lipkin et al. | 313/341 |
| 6,464,551 | B1 | 10/2002 | Lipkin et al. | 445/50 |
| 2001/0052743 | A1 | 12/2001 | Hell et al. | 313/341 |
| 2003/0025429 | A1 | 2/2003 | Hell et al. | 313/310 |

FOREIGN PATENT DOCUMENTS

| | | | |
|---|---|---|---|
| DE | 2727907 | A1 | 1/1979 |
| DE | 19911081 | A1 | 9/2000 |
| DE | 10211947 | A1 | 10/2003 |
| GB | 424593 | A | 2/1935 |

* cited by examiner

*Primary Examiner*—Courtney Thomas

(57) ABSTRACT

The invention relates the field of electron emitter of an X-ray tube. More specifically the invention relates to flat thermionic emitters to be used in X-ray systems with variable focus spot size and shape. The emitter provides two main terminals (3, 5) which form current conductors and which support at least two emitting portions (7, 9). The emitting portions are structured in a way so that they are electron optical identical or nearly identical increasing the emergency operating options in case of emitter damage.

20 Claims, 8 Drawing Sheets

EMITTER DESIGN INCLUDING EMERGENCY OPERATION MODE IN CASE OF EMITTER-DAMAGE FOR MEDICAL X-RAY APPLICATION

The present invention relates to the field of electron emitter of an X-ray tube. More specifically the invention relates to flat thermionic emitters to be used in X-ray systems with variable focus spot size and shape.

Conventional X-ray tubes for cardio-vascular applications comprise at least two separated electron emitters. Due to the small distance between cathode and anode in those tubes no beam shaping lenses are realizable. Only the cathode cup has influence on the focal spot size and shape. Within the cathode cup the emitters are geometrically separated and consequently not inline with the optical axis. Therefore each emitter only produces one focal spot. If one emitter fails due to reaching end of life by evaporation or cracking caused by thermo-mechanical stress a switch to one of the other emitters for instance for an emergency radioscopy would be possible to safely remove the catheters during catheter inspections of e.g. the heart.

U.S. Pat. No. 6,464,551B1 describes an emitting filament with three terminals or attachment posts. The two emitting filaments are mounted in one longitudinal structure supported by and electrically connected to the terminals. Each end of the emitting filament is supported by one terminal. An additional terminal supports the emitting filaments in the middle. The resulting emitting surfaces are electron optically different. Therefore emitting filaments of this structure cannot be used successfully in X-ray systems that require nearly identical electron emitting characteristics of the emitters.

Modern medical treatment requires a high sophisticated X-ray system in order to support effective diagnostic for example for cardio-vascular applications. Conventional fix focus X-ray systems played an essential role in the past but their capabilities and features cannot support requirements of modern medical applications any more. Future X-ray tube generations need to offer the possibility of a variable focal spot size and shape. Theses tubes have a large distance between cathode and anode and in-between different beam shaping lenses. To achieve optimal focusing properties of the X-ray system it is necessary to place the electron emitter on the optical axis of the lens system. Therefore, a two-emitter design is not suitable for usage in modern X-ray systems with a variable focal spot size and shape having a large distance between cathode/emitter and anode and in-between different beam shaping lenses.

Figure 1A:
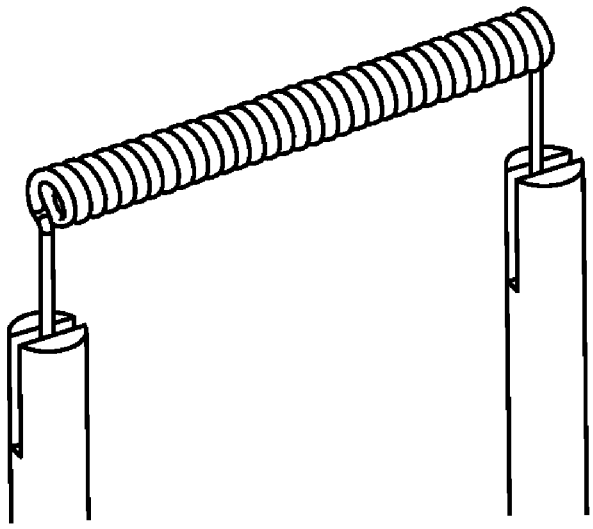
Figure 1B:
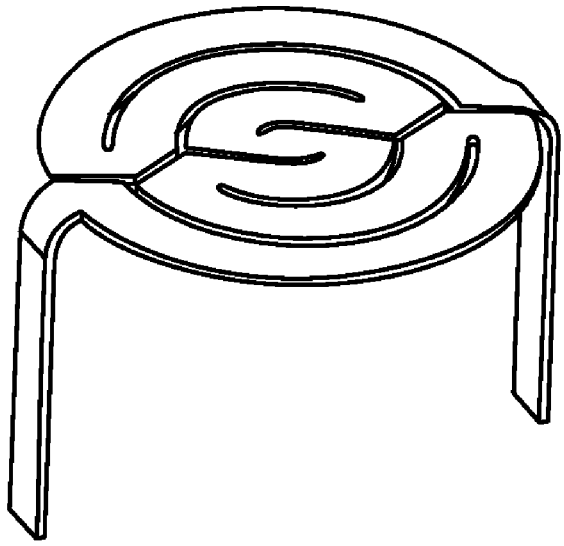

Conventional thermionic emitters for X-ray systems with variable focal spot size and shape consist of a coil or a fine-structured flat part with relative high electrical resistance which heats up by Joule heat and emits electrons if electrical current is applied. This state-of-the-art structure is fixed by two more massive conductive terminals (FIGS. 1*a*, 1*b*). If a small part of the fine structure is damaged caused by arbitrary influences, the electrical path is cut and the system fails and no redundant electron source exists and the medical inspection becomes critical.

There may be a need for an emitter for X-ray tubes that allow the usage in modern multi-focus X-ray systems combined with continuous operation options even if parts of the emitter are damaged.

To meet the above described need a new design of a thermionic emitter as described by the subject matter according to the present application.

According to another aspect of the invention there is provided an X-ray tube comprising the inventive emitter. And according to yet another aspect of the invention there is provided an X-ray-system, particularly a computer tomography system comprising the inventive X-ray tube.

Advantageous embodiments are described by the present application.

According to a first aspect of the invention there is provided an emitter for X-ray systems with two main terminals which form current conductors and which support at least two emitting portions. The emitting portions which are directly heated thermionic flat emitter are structured in a way so that the emitting portions are electron optical identical or nearly identical.

By this emitter design the new emitter can replace traditional emitters in X-ray tubes. These X-ray tubes can be operated also under condition where single part emitter would fail, e.g. if the traditional emitter burns through. So, with this new X-ray tube that has more than one emitter portion on the optical axis and that allow variable focal spot size and shape the latest requirements in cardiovascular applications are satisfy. Traditional emitters would not meet these requirements for continued operation even if a portion of the emitter is damaged.

The new inventive X-ray systems, in particular computer tomography systems, have the advantage that tumor examination can be completed even if a part of the emitter fails during the examination. This is a major contribution to the safety and reliability of the X-ray systems.

By a design in which the emitter or emitter portions lie in the same geometric plane no mechanical adjustment of the X-ray system is required if one of the emitter portions is damaged during operation.

By building the emitter portions in meander form whereby in the case of two emitter portions each emitter portion intertwines the other emitter portion comb wise the two emitting portions are seen as electron optically identical or nearly identical. This way it becomes easy to place the complete emitter with two emitting portions onto the optical axis of the X-ray system.

In an electrically set-up each emitter portion forms an electrical path between the main terminals. In this set-up, a break of the electrical path in one branch would lead to an increase of the current and consequently an increase in temperature in all other electrical parts or branches. As a consequence of this, these branches will burn through and a complete failure of the emitter results. By the option of controlling the electrical current in each branch, it is possible to avoid this chain reaction by reducing the total applied current, in case of damage of one emitting portion, to a level where all other branches are supplied with their correct application current. This set-up and operation mode leads to a reduced electron emission and X-ray image intensity/quality but allows to safely remove catheters—for example—in cardio-vascular applications.

It is known that directly heated electron emitting devices may fail due to different effects like evaporation, ion bombardment, arcing or thermo-mechanical stress. A small damage of the electrical wire usually leads to a locally high temperature caused by the increased electrical power release in that part which would accelerate the damage process by increased evaporation or melting until the electrical path is cut. If only a single path for the electrical current is available, damage affects the entire electron source. It is possible to determine the electrical resistance of the structure to detect such damages but to avoid the hot spot and therefore the failure of the entire system, it is necessary to reduce the applied current in a manner that the damaged region has a temperature below a critical value. Consequently the rest of the emitting part has a much smaller temperature and hence a drastically reduced emission. Such an operation condition is not sufficient for any emergency modes during medical inspections.

Separating the electric single path into at least two current paths connected in parallel a defect within one wire would lead to a decrease of the current in that path and an increase in the other paths (self-regulation). For a design with two emitter portions that are electrically connected in parallel to the main terminals this effect is described by the following equations 1-9:

$$I_1 = \frac{R_2}{R_1 + R_2} \cdot I \quad \text{(Eqn. 1)}$$

$$I_2 = \frac{R_1}{R_1 + R_2} \cdot I \quad \text{(Eqn. 2)}$$

Defect described by increasing the resistance:

$$0 \leq \partial << 1 \quad \text{(Eqn. 3)}$$

$$R_1^* = R_1 \cdot (1 + \partial) \quad \text{(Eqn. 4)}$$

$$R_1 = R_2 = R \quad \text{(Eqn. 5)}$$

$$I_1 = \frac{1}{2} \cdot I \wedge I_2 = \frac{1}{2} \cdot I \quad \text{(Eqn. 6)}$$

$$I_1^* = \frac{1}{2 + \partial} \cdot I \wedge I_2^* = \frac{1 + \partial}{2 + \partial} \cdot I \quad \text{(Eqn. 7)}$$

$$\frac{I_1^*}{I_1} \approx 1 - \frac{\partial}{2} \wedge \frac{I_2^*}{I_2} \approx 1 + \frac{\partial}{2} \quad \text{(Eqn. 8)}$$

$$\Rightarrow I_1^* < I_1 \wedge I_2^* > I_2 \quad \text{(Eqn. 9)}$$

Thereby, the following symbols are used:

$I_1$ is the current through one path of one emitter portion;

$I_2$ is the current through the other path of the other emitter portion;

$R_1$ is the resistor value of one path of one emitter portion;

$R_2$ is the resistor value of the other path of the other emitter portion;

$\partial$ represents a small change factor in the resistor value;

$R_1$* is the changed value of $R_1$;

$I_1$* is the new value of $I_1$ after the change in $R_1$ occurred;

$I_2$* is the new value of $I_2$ after the change in $R_1$ occurred.

By monitoring the voltage drop over the emitter it is possible to detect all changes of the structure and control the heating current. If the voltage changes faster than estimated for evaporation effects only, a small critical defect is probable and an emergency mode with decreased current can be started. The total current has to be decreased less than in single path emitters because of the above mentioned self-regulation behavior. E.g. an increase of resistance in one branch of 10% decreases the current through this branch by approximately 5%. This would not be enough to avoid melting and breaking the current path. Hence the total current has to be reduced and fitted to an emergency mode tube current. Even if the defect causes a break in that current branch, the remaining fully functional parallel emitter part is applied with the controlled correct branch current and therefore emits electrons. For the set-up with two parallel emitter portions the resulting tube current would be half the necessary application current and enough for a safe emergency mode.

In case of a short-cut in one branch the total electrical resistance decreases and hence a reduction of power occurs. A higher applied current would be necessary to achieve a sufficient tube current which is possible only for a small short-cut due to a limited current source.

For high quality X-ray pictures a well defined small focus is needed which is achieved in high end X-ray systems by complex electron optics. Those optics have high requests to the exact position of the emitter on the optical axis. It is not possible to use geometrically separated emitters to build up the redundant emitter system explained above. By using a design as explained above this problem has been overcome. Both branches are optically nearly identical and each branch for itself could be used as electron source without reducing the optical quality.

According to another embodiment of the invention the at least two emitting portions are electrically connected in series between the main terminals building an electrical mid point between the emitting portions and having a third terminal electrically connected to the electrical midpoint, whereby the third terminal forms an midpoint current conductor.

In another embodiment of the invention the emitting portions have a structure of two helix' that lie in each other building a double helix with their electrically connected midpoint in the middle of the double helix and their other end being connected to the main terminals at the outside ends of the double helix.

In this design the electron optically identical characteristics of each emitting portion are identical making it possible to position the middle of the double helix onto the optical axis of the X-ray system.

This emitter design with three terminals can be controlled much more sensitive. In this set-up, it is possible to separately measure the current in each electrical branch of the emitter portions. If a defect occurs in one branch, the current in the other branch increases and may exceed a current limit for safe operations. By reducing the applied total current to decrease both branch currents below that critical limit, the emitter will get back to an uncritical state. This leads to a reduced tube current which will be nevertheless sufficient for an emergency operation mode. Additionally, the measurement within both branches can be build up in a full bridge circuit to significantly increase the sensitivity of the monitoring. Defects can be detected much earlier than in a set-up with only two terminals.

A further advantage of a three terminal set-up in comparison to the two-terminal set-up is given in a short-cut case. By monitoring the total resistance of the emitter as well as all branch currents it is possible to detect a short-cut in one branch. In that case it is possible to break the current path in the relevant branch by opening a switch combined with a reduction of the applied total current according to the above mentioned process.

On the other side in the design with two emitter portions lying as two helix' inside each other results in a relative strong magnetic field caused by the heating current. The emitter behaves like a coil and hence produces a relatively high magnetic field. Unfortunately this affects the electron optic in a negative way.

This relative strong magnetic field can be overcome by yet another embodiment of the invention where there is provided a fourth terminal. The helix like emitter portions as described above are not electrically connected at their midpoint in the center of the double helix. Instead two separate inner terminals are provided such that the helix like emitter portions are electrically isolated against each other, so that the current path is cut between the two branches. This way the current can be applied contrariwise in the branches and the resulting amplitude of the magnetic fields are much better distributed across the emitting portions. A significant reduction in amplitude is achieved by the additional terminal.

Compared to a two terminal solution the three terminal or four terminal solutions are much more stable an inured to vibrations.

In yet another embodiment of the invention the emitting portions each have a meander structure and are intertwined comb wise or lying side by side. The midpoint current conductor is provided on one end of the meander structures and the two main terminals are each provided at the other end of the meander structures. This way the temperature distribution across the emitter is much better compared to the double helix design. In the double helix design the temperature is pretty much equal across the helix structure with the exception of the midpoint. The reason is the third or fourth terminal—in the four-terminal design—at which heat is conducted into the terminal. Consequently the emitting electron distribution is better in case of the meander structure because a central relatively cold centre region is avoided which could have a negative influence on the intensity distribution of the focal spot.

With emitter portions that lie with their meander structure side by side building two electrical and geometrical parallel meander branches the risk of an electrical inter-branch connection by melting can be reduced. By sufficiently dimensioning the width of a separating slit between the two branches a in length direction, this risk can be drastically reduced.

All above mentioned designs are practicable for DC and AC emitter current supply.

In case of a three terminal solution with an electrical middle terminal it is also possible to handle fast damages like cracks and short-cuts within the current path if only AC emitter current is supplied. By inserting diodes contrariwise within the current paths to/from the main terminals each emitter portion is heated up by only one half-wave of the current supply.

The advantage is that a crack in one path does not influence the current in the other branch which hence operates in its normal mode. The current distribution for a short-cut in one emitter portion is equal to the non-damaged set-up. Due to the reduced resistance in the short-cut portion, less power is released and therefore a decrease in temperature and emission results in this part. The uninfluenced emitter part still works in the normal operation mode and, in case of two emitter portions in parallel, with half the electron emission than necessary for the application which is still sufficient for an emergency mode. By implementing a current sensor (e.g. from LEM-ELMS, Pfäffikon, Switzerland) combined with a Hall-sensor it is possible to easily detect both damages by measuring the AC and DC component of the current.

So, the basic idea is providing an emitter with more than only one emitter portion which are electron optical identical or nearly identical. The emitter portions can electrically either be operated in a parallel mode with voltage and current measurement and control. In a parallel mode the emitter portions may have each a meander structure and the portions may intertwine comb wise. Alternatively the emitter portions can be operated electrically in a series mode with a middle terminal with a variety of geometric designs that are all electron optically identical or nearly identical. A double helix or double meander structures can be used. The meander structures may be intertwined or side by side. And the usage of diodes in the current path to the main terminals allows an electrical set-up without complex control systems for the power supply. This reduced complexity enhances the price-performance ratio and the longevity of the final product, e.g. an X-ray tube or an X-ray system.

The invention will be described in more detail hereinafter with reference to examples of embodiment but to which the invention is not limited.

Figure 2A:
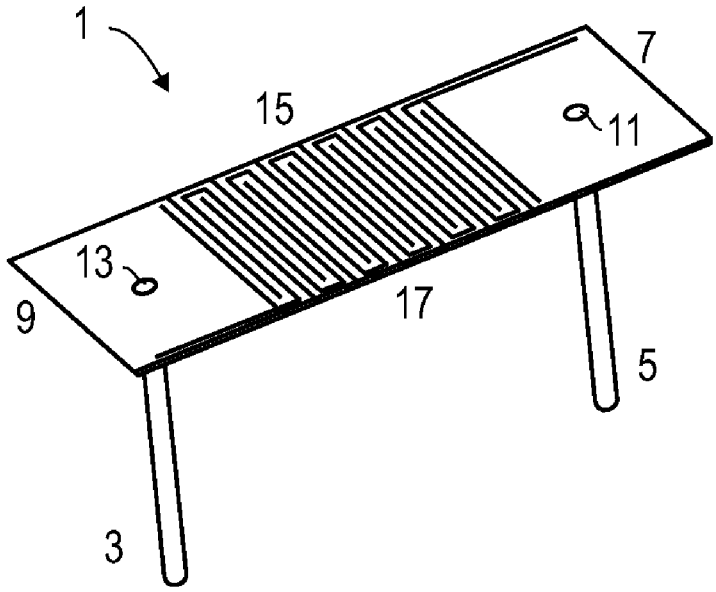
Figure 2B:
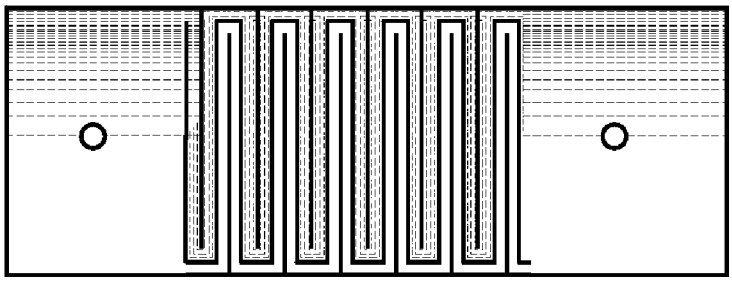
Figure 3:
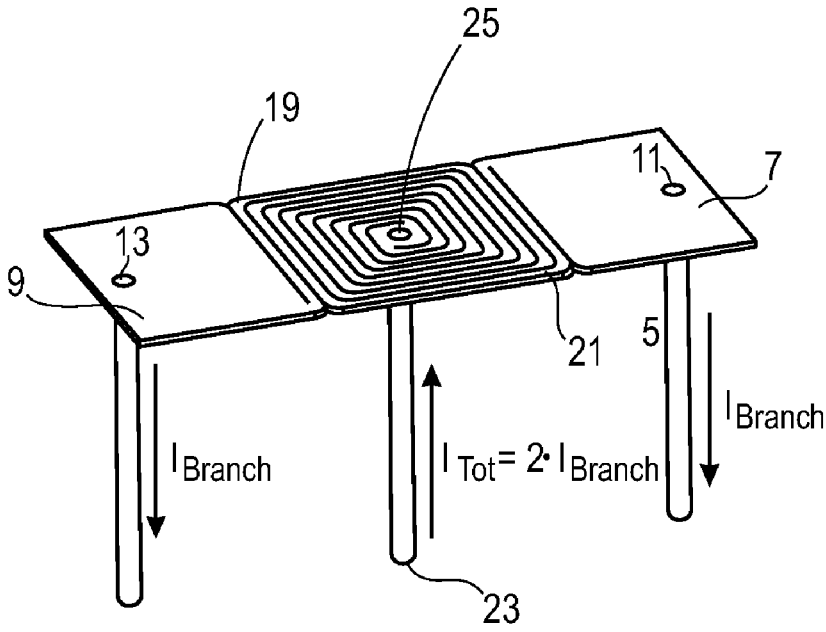
Figure 4:
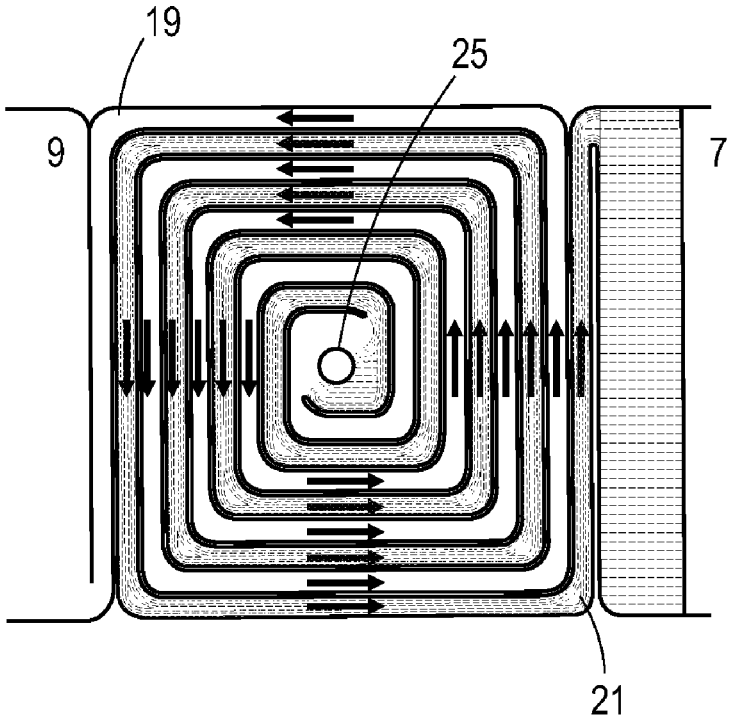
Figure 5:
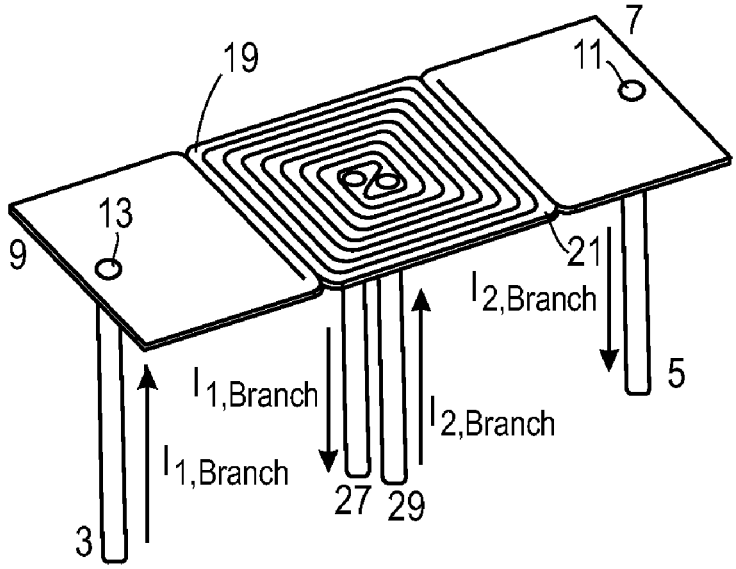
Figure 6:
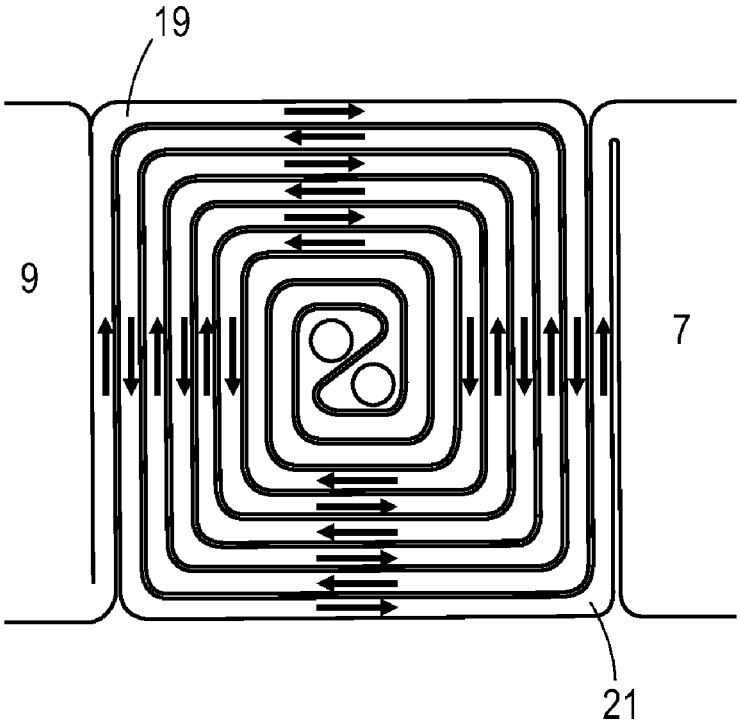
Figure 7:
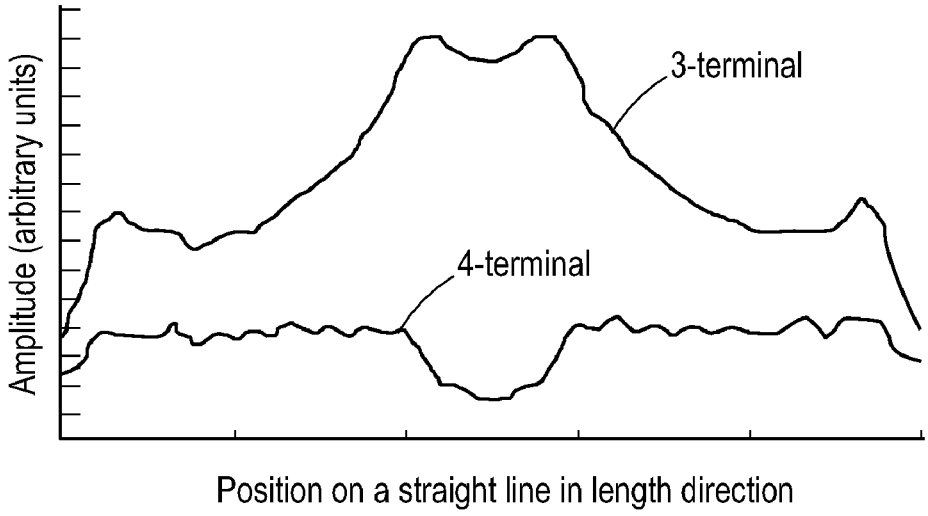
Figure 8:
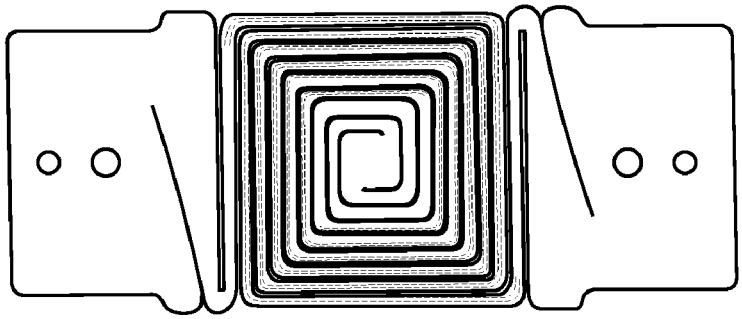
Figure 9A:
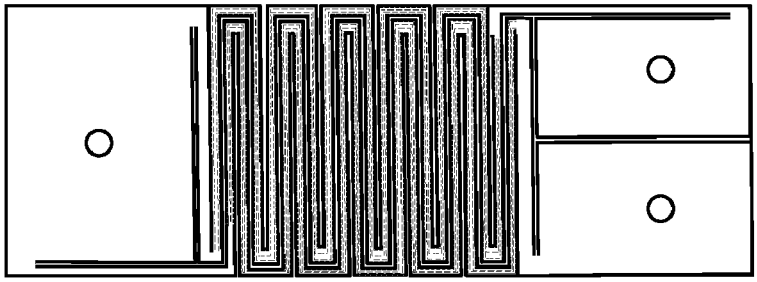
Figure 9:
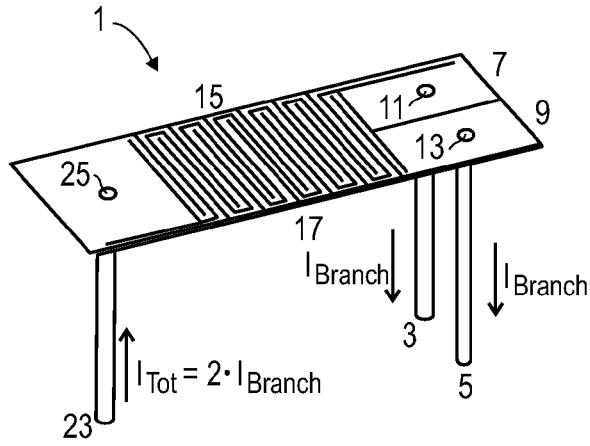
Figure 10:
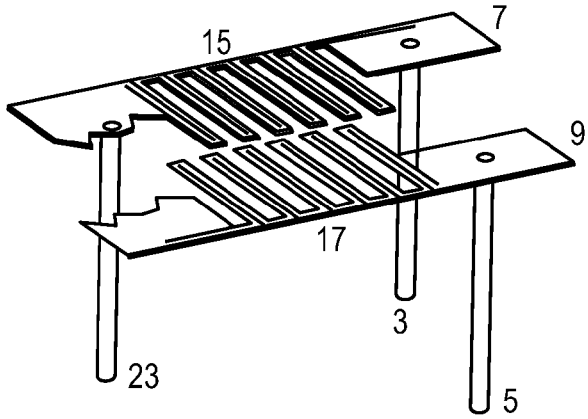
Figure 11:
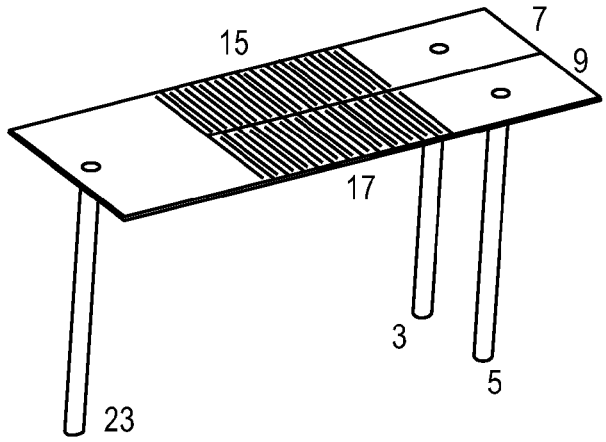
Figure 12:
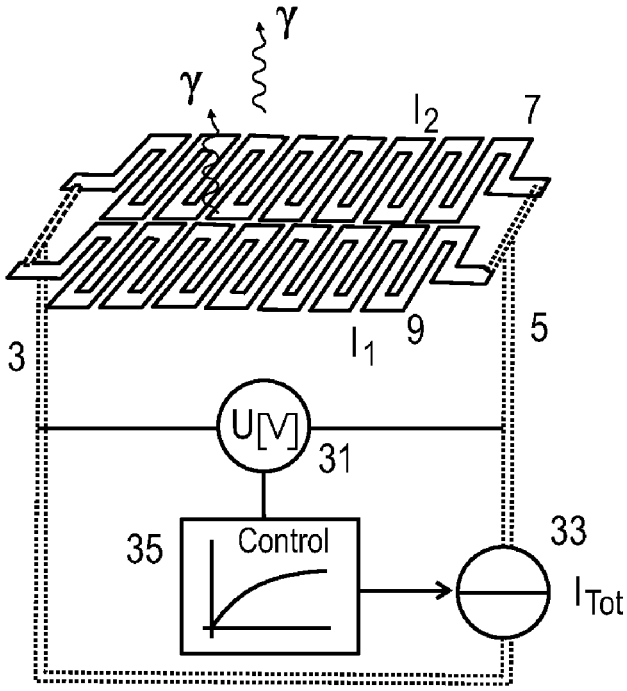
Figure 13:
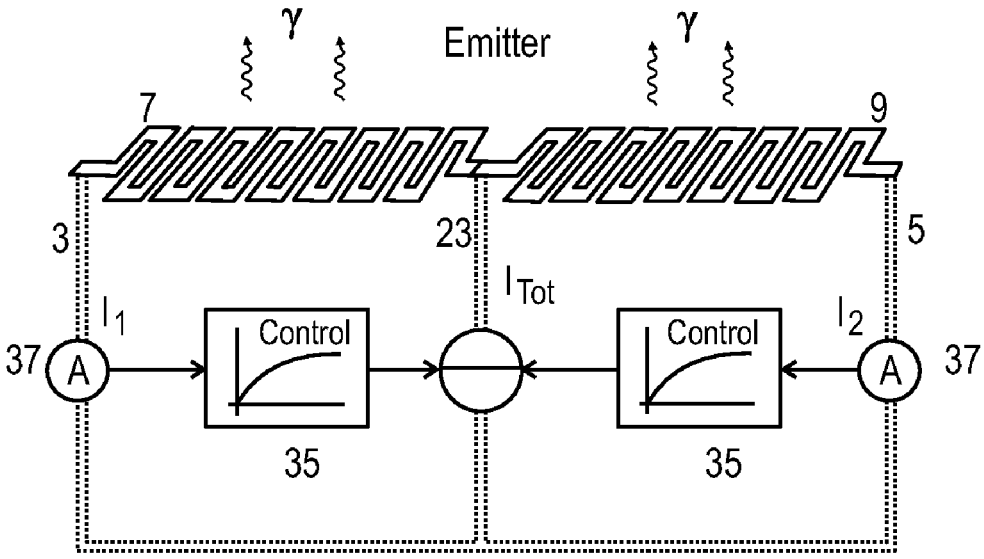
Figure 14A:
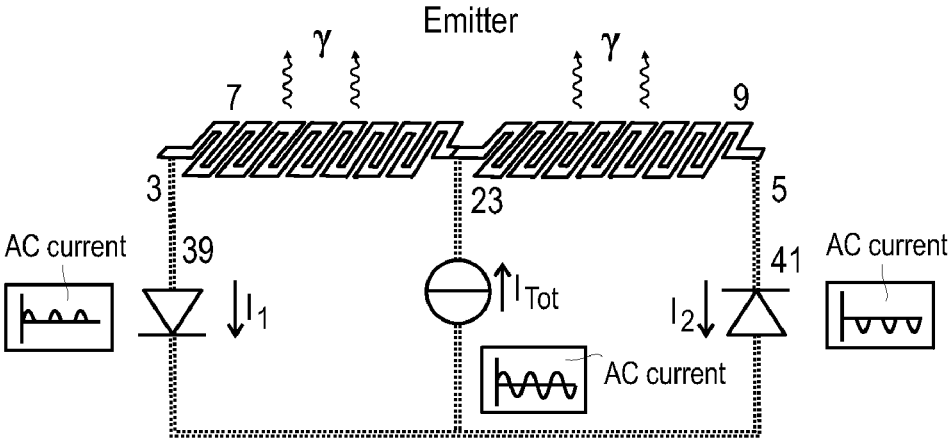
Figure 14B:
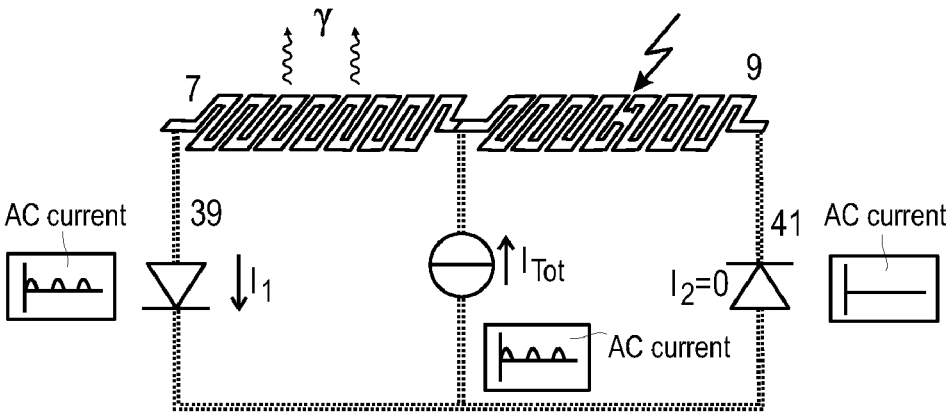
Figure 14C:
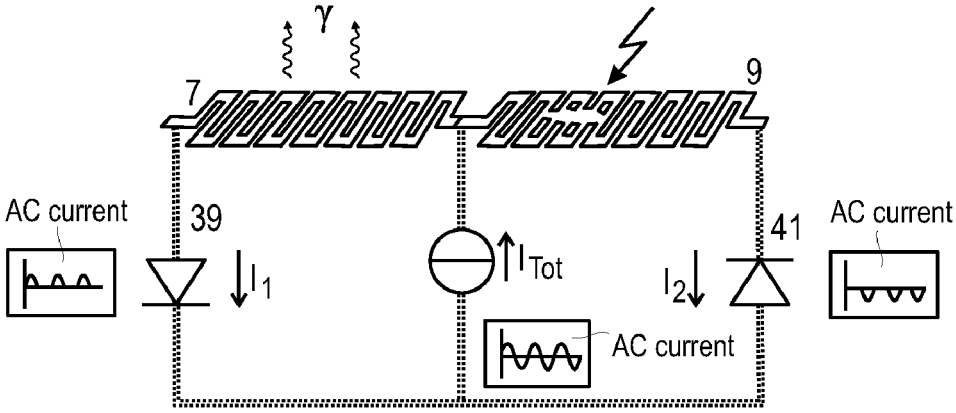

The illustration in the drawing is schematically. It is noted that in different figures, similar or identical elements are provided with the same reference signs. The figures show:

FIG. 1*a* a conventional thermionic coil emitter;

FIG. 1*b* a conventional thermionic flat meander emitter;

FIG. 2*a* a flat emitter with two meander structures in a parallel circuit which are optically nearly identical;

FIG. 2*b* flat emitter with the 2 parallel current branches through the emitter;

FIG. 3 an emitter design with two helix-structures combined in a parallel circuit to a double helix structure;

FIG. 4 the current direction in a double helix emitter comprising 3 terminals with optically identical current paths (coil behavior);

FIG. 5 a double helix emitter with four terminals to reduce the magnetic field caused by the heating current;

FIG. 6 the current flow in a double helix emitter with four terminals;

FIG. 7 the amplitude of the magnetic field of an emitter with three and four terminals respectively in parallel circuits;

FIG. 8 the temperature distribution of the double helix emitter;

FIG. 9 a proposed double meander emitter with 3 terminals having no cold centre area;

FIG. 9*a* the temperature distribution of the double meander emitter;

FIG. 10 the two different electrical paths of a double meander emitter with 3 terminals;

FIG. 11 3-terminal emitter with two non-interleaved meander structures to avoid inter-branch short-cuts in case of damage;

FIG. 12 defect control for a two-terminal set-up in electrically parallel set-up;

FIG. 13 electrical set-up and operation mode of an emitter designed in a geometrically parallel set-up, whereby the optically identical emitter areas are separated to better visualize the principle set-up;

FIG. 14*a* set-up with diodes to avoid a complete emitter failure due to fast local damages within the emitter structure;

FIG. 14*b* current flow in case of an emitter break in one emitting portion;

FIG. 14*c* current flow in case of a short-cut in the current path in one emitting portion.

FIG. 2*a* shows a preferred embodiment of the current application using two main terminals 3, 5 connected to an emitter 1 with two emitting portions 7, 9. The two emitting portions 7, 9 of the emitter 1 are connected to the terminals 3, 5 at the contact points 11, 13. As can be seen from FIG. 2*a*, the two emitting portions 7, 9 of the emitter 1 lie in each other having both meander structures. It can also be seen from FIG. 2*a* that the two emitting portions 7, 9 lie in the same geometrical plane. Typically emitters of this form are manufactured from a metal plate into which slits are cut so that the double meander structure is built. In this emitter design the two emitting portions 7, 9 intertwine each other comp wise.

If an electrical current is supplied to the two main terminals 3, 5 there are two electrical branches or paths so that a current from main terminal 3 can flow via the contact 13 between the terminal 3 and the emitting portion 9 through the two emitting portions 7, 9 via the two meander structures 15, 17 to the contact 11 between terminal 5 and emitting portion 7 to the main terminal 5. Because of a Joule heat induced by the current flowing through the two meander structures 15, 17 build two electron optical identical emitter portions 7, 9. FIG. 2*b* illustrates the current paths through the emitter. This type of emitter can be placed with its center of its emitting surface vertically to the optical axis of an X-ray system.

If one or the two emitting portions 7, 9 are damaged during operation, the other emitter portion continuous to work properly. This way cardio-vascular applications can be supported also in cases where X-ray tubes with a variable focal spot size and shape is required. These X-ray tubes normally have a large distance between cathode and anode and require an emitter that is placed on the optical axis of the X-ray system.

FIG. 2*b* illustrates the two different current paths from one contact point 11 between a terminal 5 and an emitting portion 7 and the other contact point 13 between a terminal 3 and an emitting portion 9.

FIG. 3 shows a different design of an emitter with two emitting portions 7, 9. In this case the two emitting portions 7, 9 are connected electrically in series. The electrical mid point is connected to terminal 23 at the contact 25 between mid point terminal 23 and the emitting portions 7, 9. As can be seen from FIG. 3, the emitting portions are in a helix form 19, 21 that lie in each other. The complete emitter is formed from a metal plate into which slits are cut so that the double helix structure is designed. Electron optically, the two emitting portions according to the design of FIG. 3 are identical.

The complete emitting surface of the two emitting portions 7, 9 can easily be placed vertically to the optical axis of an X-ray system. Because of a central mid point terminal 23 connected to the two emitting portions 7, 9 at the contact 25 between the mid point terminal 23 and the emitting portions 7, 9 an electrical current can flows simultaneously through the two different helix form parts 19, 21 of the two emitting portions 7, 9. This results in a relative strong magnetic field caused by the heating current. The emitting portions 7, 9 behave like coils and hence produce a relative high magnetic field. This effect is undesired in X-ray systems because it affects the electron optic in a negative way.

This negative effect could be overcome by another embodiment of the current application. FIG. 5 shows another emitter design. In this case, the two portions 7, 9 of the emitter do not have a common mid point. Instead two additional terminals 27, 29 are provided in the middle of each helix 19, 21 of the two emitting portions 7, 9. Now two electrical paths could be provided. One path is built by terminal 5, contact 11 between terminal 5 and emitting portion 7, the helix structure 21 of emitting portion 7 which is connected to terminal 29 in the middle of the helix structure 21. The other electrical part is built symmetrically by terminal 3, contact 13 between terminal 3 and emitting portion 9, the helix structure 19 of emitting portion 9 which is connected to terminal 27 in the middle of the helix structure 19 of emitting portion 9.

As can be seen from FIG. 6, two current flows in different directions could now be sent through the double helix structure. The resulting magnetic field is much lower as illustrated by FIG. 7. The three terminal solution as described by FIG. 3 has a relatively high magnetic activity in the middle of the double helix structure. This undesirable effect could basically be eliminated by a four terminal solution with two terminals 27, 29 in the middle of the double helix structure 19, 21 of the two emitting portions 7, 9.

FIG. 8 gives an impression of the temperature distribution in case the two emitting portions 7, 9 are built in helix structure 19, 21 that lie in each other. It should be appreciated that the highest temperature is reached within the double helix structure. The outer parts of the emitting portions 7, 9 have a much lower temperature as well as the mid point of the helix structure that is connected at the contact 25 between the mid point terminal 23 and the emitting portions 7, 9 to the mid point terminal. The terminals not only work as the electrical connections to the emitting portions but also as heat sinks.

The relative cold center of the emitter that is typically placed on the optical axis of an X-ray system could have a negative influence on the intensity distribution of the focal spot of the X-ray system. However, from a mechanical point of view these designs with all terminals in a geometrical row are much more stable and inured to vibrations.

The slight disadvantage of having a cold center in the middle of the emitter but still provide the three or more terminal advantages could be overcome by another embodiment of the current application. This alternative embodiment is shown in FIG. 9.

The embodiment of FIG. 9 is incorporating a lot of the advantages available through the other embodiments already discussed. In this embodiment the emitter consists of two emitting portions 7, 9 being electrically connected in series with a mid point terminal 23. In between each main terminal 3, 5 each emitting portion 7, 9 has a meander structure 15, 17. The common middle point portion of the emitter 1 is connected to the contact 25 between mid point terminal 23 and emitting portions 7, 9. As in the other embodiments contacts 11, 13 between the main terminals 3, 5 and the emitting portions 7, 9 serve as electrical contact and mechanical support of the emitter 1. Mid point terminal 23 supports the emitter 1 at the other geometrical end.

FIG. 10 shows the embodiment that is shown in FIG. 9 in an explosive illustration. The two meander-like structures 15, 17 are clearly distinguishable and can each be identified as part of the emitting portions 7, 9 of the emitter 1. The two different current branches are clearly visible.

In FIG. 9*a* the temperature distribution over the emitter 1 of the embodiment of FIG. 9 is illustrated. The two meander structures 15, 17 of the two emitting portions 7, 9 of the emitter 1 show a homogeneous temperature distribution while the outer parts of the emitting portions 7, 9 that are connected to the terminals 3, 5, 23 have a much lower temperature of about 600° C. The meander structure in this embodiment has a homogeneous temperature of about 2.400° C. The cold point in the middle of the double helix structure of the emitting portions 7, 9 can clearly be avoided.

The meander-like structures as shown in FIGS. 9 and 10 bear a certain risk that the two electrical branches through the emitting portions 7, 9 influence each other by melting. It could be possible that inter-branch connections are produced. Such an inter-branch connection would risk the function of the complete emitter 1. This problem could be overcome by another embodiment of the current application that is shown in FIG. 11. In this case a mechanical separation of the intertwined meander structures 19, 21 of the two emitting portions 7, 9 is shown. Electrically there is no difference. But mechanically the two meander structures 19, 21 are geometrically arranged in parallel with respect to each other. This way the risk of an electrical inter-branch connection can be decreased very much. By sufficiently dimensioning the width of the separating slit in a length direction between the two meander structures 19, 21 of the two emitting portions 7, 9, this risk can be drastically reduced.

Next, the electrical set-up for the embodiment with parallel connected emitting portions 7, 9 to the main terminals 3, 5 is described. In this set-up, a break in the electrical path in one branch by either through emitting portion 7 or emitting portion 9 would lead to an increase of the current in the other electrical path. Consequently, this would lead to an increase in temperature of the still working emitting portion. As a consequence of this temperature increase this branch will burn through as well and a complete failure of the emitter 1 would be the result. By the option of controlling the electrical current by current control means 33—e.g. a variable current source—in each branch, it is possible to avoid this chain reaction by reducing the total applied current $I_{Tot}$, in case of damage of one emitting portion. For that purpose it is necessary to reduce the applied current $I_{Tot}$ in a manner that the damaged region has a temperature below a critical value. Consequently, the other emitting portion has a much smaller temperature and hence a reduced emission. However, by monitoring the voltage drop with voltage measurement means 31—e.g. an electronic voltage meter—over the emitter 1 it is possible to detect all changes of the structure and control the heating current $I_{Tot}$. In case of two emitting portions 7, 9 being electrically connected in parallel, the change in current induced by a change of the resistance of one of the two emitting portions 7, 9 can be determined by Eqn. 1 to 9.

Next, the electrical set-up of a three terminal solution will be discussed. The general set-up of this solution is shown in FIG. 13.

The two emitting portions 7, 9 are here shown as meander structures but may well be also in the form of two helix structures that lie in each other as shown in FIG. 3. This emitter design with three terminals 3, 5, 23 can be controlled much more sensitive. In this set-up, it is possible to separately measure the current in each electrical branch of the emitting portions by independent controllers 35. If a defect occurs in one branch, the current in the other branch increases and may exceed a current limit for save operations. By reducing the applied total current $I_{Tot}$ to decrease both branch currents below that critical limit, the complete emitter 1 will get back to an uncritical state. This will lead to a reduced X-ray tube current which will be nevertheless sufficient for an emergency operation mode.

Additionally, the measurement within two branches which are built by the two emitting portions 7, 9 can be built up in a full bridge circuit to significantly enhance the sensitivity of the monitoring. Defects can be detected much earlier than in a set-up with only two terminals 3, 5.

In case of a short-cut in one of the two branches being built by the emitting portion 7, 9 and by monitoring the total resistance of the emitter 1 as well as all branch circuits through the emitting portions 7, 9 it is possible to detect the short-cut in one branch. In this case it is possible to break the current path of the relevant branch—in this case either through emitting portion 7 or emitting portion 9—by opening a switch (not shown) combined with a reduction of the applied total current $I_{Tot}$ according to the above-mentioned process. Numeral 37 represents means for current measurement in this case.

Another advantage of the three terminal solution is a simpler electrical set-up that can operate without controllers 35 to control the total current $I_{Tot}$ but that make it also possible to handle fast damages like cracks or short-cuts within the current path if only AC emitter current is applied as illustrated by FIG. 14*a*. By inserting diodes 39, 41 contrary-wise within the current path to/from the main terminals 3, 5, each emitting portion 7, 9 is heated up by only one half-wave of the current supply. A crack—as shown in FIG. 14*b*—in one path does not influence the current in the other branch which hence operates in its normal mode. The current distribution for a short-cut—as shown in FIG. 14*c*—in one emitting portion 7, 9 is also equal to the non-damaged set-up.

Due to a reduced resistance in the short-cut portion, less power is released and therefore a decrease in temperature and emission results in this portion of the emitter 1. The uninfluenced emitting portion still works in the normal operation mode. In this case, only half the electron emission that would be necessary for a full function X-ray system would be available. However, the electron emission is still sufficient for an emergency mode. By additionally implementing a current sensor combined with a Hall-sensor (not shown) it is possible to easily detect both damages by measuring the AC and DC component of the current.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

LIST OF REFERENCE SIGNS:

| | |
|---|---|
| 1 | emitter |
| 3 | terminal |
| 5 | terminal |
| 7 | a first emitting portion |
| 9 | a second emitting portion |
| 11 | contact between terminal and emitting portion |
| 13 | contact between terminal and emitting portion |
| 15 | meander structure |
| 17 | meander structure |
| 19 | helix form emitting portion |
| 21 | helix form emitting portion |
| 23 | mid point terminal |
| 25 | contact between mid point terminal and emitting portions |
| 27 | terminal |
| 29 | terminal |
| 31 | voltage measurement means |
| 33 | current control means |
| 35 | controller |
| 37 | means for current measurement |
| 39 | diode |
| 41 | diode |

The invention claimed is:

1. An emitter for an X-ray system comprising:

two main terminals which form current conductors and which support at least two emitting portions, wherein the emitting portions are structured such that the emitting portions are electron optically nearly identical, wherein a voltage measuring device and a current controller are connected to the two main terminals.

2. The emitter according to claim 1, wherein the emitter is a directly heated thermionic flat emitter.

3. The emitter according to claim 2, wherein the at least two emitting portions have an emitting surface in a same plane.

4. The emitter according to claim 3, wherein the at least two emitting portions are electrically connected in parallel to the two main terminals.

5. The emitter according to claim 4, wherein the at least two emitting portions have a meander structure.

6. The emitter according to claim 5, wherein the two meander structures of the emitting portions intertwine comb wise.

7. The emitter according to claim 3, wherein the at least two emitting portions are electrically connected in series between the main terminals building an electrical midpoint between the emitting portions, and having a third terminal electrically connected to the electrical midpoint, wherein the third terminal forms a midpoint current conductor.

8. The emitter according to claim 7, wherein the at least two emitting portions have a helix structure for forming a double helix, wherein the electrical midpoint is arranged in a middle location of the double helix and the main terminals are connected to ends of the double helix.

9. The emitter according to claim 7, wherein the at least two emitting portions have a meander structure.

10. The emitter according to claim 9, wherein the meander structure of the emitting portions intertwine comb wise or lie side by side, and the third terminal which forms a midpoint current conductor is geometrically at one common end of the emitting portions and other ends of the emitting portions are each connected at a geometric opposite side to one of the two main terminals lying side by side.

11. The emitter according to claim 2, wherein a voltage measurement device and a current control are connected to the two main terminals.

12. The emitter according to claim 7, wherein the third midpoint terminal forms a central current supply for electrical branches from the third midpoint terminal to each main terminal, wherein each branch has a current measurement device connected to the main terminals to measure current and/or current difference in a full bridge circuit.

13. The emitter according to claim 7, wherein diodes are included contrariwise in each electrical branch of the double helix such that the diodes are connected to the main terminals.

14. An X-ray tube comprising the emitter as set forth in claim 1.

15. An X-ray system comprising the X-ray tube as set forth in claim 14.

16. An emitter for an X-ray system comprising:

two main terminals which form current conductors and which support at least two emitting portions, which are electron optically nearly identical, the at least two emitting portions each having a helix structure forming a double helix, the double helix having outer ends which are connected to one of the two main terminals and the double helix further having at least one of:

inner ends connected independently to two inner terminals which form inner helix current conductors, and an electrical midpoint being electrically connected to a third terminal to form a midpoint current conductor.

17. An X-ray tube including the emitter of claim 16.

18. The emitter according to claim 16, wherein the emitter is a directly heated thermionic flat emitter and the at least two emitter portions have an emitting surface in a common plane.

19. An emitter for an X-ray system comprising:

two main terminals which form current conductors and which support at least two emitting portions, the emitting portions structured as electron optically nearly identical and having a emitting surface in a common plane, the at least two emitting portions being connected to the main terminals and a third terminal electrically connected to an electrical midpoint between the emitting portions; and at least one of: diodes electrically connected contrariwise with the main terminals and a current measurement device electrically connected with the main terminals.

20. An X-ray tube including the emitter of claim 19.

* * * * *